United States Patent [19]

Granger et al.

[11] Patent Number: 5,044,603

[45] Date of Patent: Sep. 3, 1991

[54] VARIABLE BORE RAM RUBBER WITH NON-OVERLAPPING INSERTS

[76] Inventors: Stanley W. Granger, 23800 Gold Nugget, Diamond Bar, Calif. 91765; Joseph O. Beard, 1625 N. Lincoln Ave., Fullerton, Calif. 92631; Frode Sveen, 12697 Orgren Ave., Chino, Calif. 91710

[21] Appl. No.: 576,277

[22] Filed: Aug. 31, 1990

[51] Int. Cl.[5] ..... E21B 33/06

[52] U.S. Cl. ..... 251/1.3; 277/127; 277/199

[58] Field of Search ..... 251/1.1, 1.3; 277/126, 277/127, 192, 199

[56] References Cited

U.S. PATENT DOCUMENTS

| | | | |
|---|---|---|---|
| 4,089,532 | 5/1978 | Kanyshuikov et al. | 251/1.3 X |
| 4,550,895 | 11/1985 | Shaffer | 251/1.3 |
| 4,930,745 | 6/1990 | Granger et al. | 251/1.3 X |

*Primary Examiner*—John C. Fox

*Attorney, Agent, or Firm*—William L. Chapin

[57] ABSTRACT

An improved sealing device for variable bore ram blowout preventers of the type that uses a pair of opposed semi-cylindrical ram blocks to urge a pair of resilient sealing elements into sealing circumferential contact with the circumferential surface of a tubular drill string component includes a generally uniform thickness sealing member having in plan view the shape of a semi-circular arch with co-linear rectangular legs which protrude laterally outwards from opposite base ends of the arch. The sealing device includes two identical sealing members, each of which has a plurality of laterally spaced apart metal inserts molded into a resilient matrix. Each insert has a pair of generally flat and parallel upper and lower plates joined by a pedestal disposed perpendicularly between the plates. Five inserts are used; two identical, generally square cross-section end inserts, one each located near the outer lateral end of each leg, two identical, trapezoidal cross-section corner inserts, one each laterally inward of each end insert, and a semi-annular cross-section center arch insert within the center arch section, adjacent the corner inserts. Forcible contact of the front face of each sealing member with a tubular component causes the corners inserts to move laterally away from the end inserts and toward the center insert, thereby forming an effective seal with tubular components of various diameters.

3 Claims, 5 Drawing Sheets

VARIABLE BORE RAM RUBBER WITH NON-OVERLAPPING INSERTS

FIELD OF THE INVENTION

The present invention relates to devices used in the drilling and operation of subterranean and sub-sea wells, primarily oil and gas wells. More particularly, the invention relates to an improvement in the seals or "ram rubbers" used in variable bore ram blowout preventers, for preventing pressurized gases or liquids from blowing out of the well.

BACKGROUND OF THE INVENTION

In drilling for natural gas or liquid petroleum, a drill string consisting of many lengths of threaded pipes screwed together and terminated by a drill bit head is used to bore through rock and soil. The drill bit head has a larger diameter than the pipes forming the drill string above it. The upper end of the drill string is rotated to transmit a rotary boring action to the drill bit head.

In a typical drilling operation, a specially formulated mud is introduced into an opening in an upper drill pipe. The mud flows downward through the hollow interior of the pipes in the drill string and out through small holes or jets in the drill bit head. Since the drill bit head has a larger diameter than the drill string above it, an elongated annular space is created during the drilling process which permits the mud to flow upwards to the surface. The purpose of the mud is to cool the drill bit, carry cuttings to the surface, and provide a downward hydrostatic pressure which counteracts pressure which might be encountered in subsurface gas pockets.

In normal oil well drilling operations, it is not uncommon to encounter subsurface gas pockets whose pressure is much greater than could be resisted by the hydrostatic pressure of the elongated annular column of drilling mud. To prevent the explosive and potentially dangerous and expensive release as gas and/or liquid under pressure upwards out through the drill hole, blowout preventers are used. Blowout preventers are mounted in a pipe casing surrounding a drill hole, near the upper end of the hole.

Typical blowout preventers have a resilient sealing means which can be caused to compressively contact the outer circumferential surfaces of various diameter drill string components, preventing pressurized liquid or gas in subterranean pockets from blowing out material along the drill string. Usually, the resilient sealing means of a blowout preventer is so designed as to permit abutting contact of a plurality of individual sealing segments, when all elements of a drill string are removed from the casing. This permits complete shutoff of the well, even with all drill string elements removed. Most oil well blowout preventers are remotely actuateable, as by a hydraulic pressure source near the drill hole opening having pressure lines running down to the blowout preventer.

Ram blowout preventers (BOP's) utilize a pair of opposed semi-circular disc-shaped sealing elements driven radially inwards into peripheral sealing contact with tubular pipe or other drill string components extending through the bore of the BOP. Each of the semi-circular ram sealing elements has a flat diametrical face in which a coaxial, semi-circular groove is formed. The grooves are adapted to conformally engage opposite halves of the cylindrical surface of a tubular drill string component.

Usually, resilient elements are incorporated into the ram sealing elements which allow the notched faces of the two sealing elements to form a tight seal against the periphery of a tubular drill string component within the bore of the BOP. Providing resilient elements allows a pressure-tight seal to be made around the periphery of tubular drill string components having a slight variation in outer diameter. The seal must be effective against well-hole pressures as high as 15,000 psi.

Variable bore ram rubbers or sealing elements are used in the drilling and workover of deep oil and gas wells when the drill string is made up of pipes of different sizes, forming what is referred to as a tapered string. Ram rubbers of variable bore design are adapted to effect pressure-tight seals against the peripheral surface of pipes of various diameters.

Variable bore rams in current use employ a special variable bore ram block which is structurally different from ram blocks intended for use with fixed diameter drill string components.

Variable bore ram blocks have a deeper cavity or, "rubber pocket" which is necessary to provide sufficient rubber to effect a positive seal with various diameter pipes. Because of the use of special ram blocks, variable bore ram assemblies are considerably more expensive than standard, fixed bore ram assemblies. Consequently, most small drilling operators do not use variable bore ram assemblies, and their use is limited even among larger operators. However, more extensive use of variable bore rams would be desirable, since their use can provide substantial savings in operating time, by eliminating the requirement of halting movement of drill pipe to change to a different size, fixed-bore ram assembly for each size of pipe in a drill string.

In addition to the operating time savings afforded by the use of a variable bore ram, there are safety advantages. Thus, a variable bore ram assembly may be actuated to form an effective blowout seal on piping of any diameter in the bore of the ram assembly.

On the other hand, with a fixed bore ram blowout preventer, if a drill string needs to be pulled quickly due to some emergency, the fixed bore ram assembly is unable to effect a seal when piping of smaller diameter than that which it is designed to seal is present in the bore of the ram assembly.

From the foregoing discussion, it should be apparent that it would be desirable to have a variable bore ram rubber which would fit in a standard, fixed bore pipe ram block. Also, it would be desirable to have variable bore ram rubbers which would overcome certain limitations inherent in existing variable bore ram rubbers, as will now be described.

Existing variable bore ram rubbers typically include a uniform thickness sealing element generally shaped in plan-view cross-section somewhat like a symmetrical, semi-circular arch. Additionally, some sealing elements have straight, coplanar legs joining the opposite ends of the arch, and extending laterally outwards therefrom. One such sealing element is installed in each of two opposed, semi-circular ram blocks, the flat bases of the legs of opposing sealing elements abutting each other to form a pressure-tight seal, and the concave semi-circular surfaces of opposed arches sealing against opposite cylindrical sides of a tubular drill string component passing through the bore of the ram sealing assembly, the bore being defined by the union of the two semi-circular cross-section arches.

To provide the necessary resilience to form an effective seal, existing sealing elements usually include a molded rubber matrix. Metal segments or inserts are molded into the matrix to provide required strength and rigidity to the sealing element. Typically, the metal segments or inserts are coextensive with the thickness dimension of the sealing element.

Resilient sealing elements of ram blowout preventers require rugged metal inserts to be interspersed with the resilient rubber matrix to add strength to the sealing elements. Such strength is required because the required sealing forces on a five-inch diameter pipe, for example, can be as high as 500,000 lbs. Also, the sealing element is sometimes required to grip a long string of drill pipe to prevent it from falling down into the well hole. The weight of a string of 5-inch drill pipes can approach the tensile strength of pipe, i.e., 600,000 lbs.

Most prior art variable bore ram sealing elements use a large number of metal inserts or segments, typically 10 to several dozen. The large number of segments is used to permit the sealing elements to conform to various pipe sizes, usually in the range diameter between 3½ inches and 5 inches.

Prior art variable bore ram sealing elements utilizing a large number of metal segments include Nelson, U.S. Pat. No. 4,332,367, July 1, 1982, which discloses the use of non-overlapping segments, and Le Rouax U.S. Pat. No. 3,915,426, Oct. 28, 1975, which discloses the use of overlapping segments.

The use of a substantial number of metal segments in existing variable bore ram sealing elements has a number of disadvantages. One such disadvantage results from the fact that every interface between segments has rubber which can extrude between the segments. Extruded rubber is pinched and cut off each time the seal is compressed into a closed position, decreasing the life of the seal.

Another disadvantage of using a large number of metal segments in a variable bore ram sealing element is that the small size of the segments makes their movement towards one another during compressive sealing somewhat unpredictable, owing to the fact that some segments will stick and some will move more readily than others. This causes gaps in sealing effectiveness to occur, especially at the corners of the sealing elements, i.e., the junctions between the straight legs and arch of a sealing element half. Also, it would be desirable for the sealing element to have greater strength at the corners, where stresses are greater during compressive sealing. This strengthening is not feasible with existing sealing elements which employ a large number of metal segments of generally uniform size and shape.

With the aforementioned limitations of prior existing variable bore ram rubber seals in mind, the present inventors conceived of an improved variable bore ram rubber. The improved sealing element, disclosed in U.S. Pat. No. 4,930,745, June 5, 1990 Granger et al., Variable Bore Ram Rubber, utilizes a sparse number of slidably interleaved inserts imbedded in a rubber matrix to provide a sealing apparatus which is highly effective for use with drill string components lying within a broad range of diameters, 2½ inches to 5 inches, for example. The present invention was conceived of to provide a simplified variable bore ram rubber which is useable over a somewhat reduced diameter range and pressure range than the aforementioned improved sealing element.

OBJECTS OF THE INVENTION

An object of the present invention is to provide an improved variable bore ram rubber, for ram blowout preventers, which has greater potential useful life and fewer component parts than existing variable bore ram rubbers.

Another object of the invention is to provide a variable bore ram rubber which is useable in a variety of ram blocks.

Another object of the invention is to provide a variable bore ram rubber which can seal effectively around the periphery of tubular well components having a diameter lying in an appreciably wide range of diameters.

Another object of the invention is to provide a variable bore ram rubber having metal segments which co-act with one another and with the resilient matrix in which they are embedded to move in repeatable fashion when the ram rubber is compressed or released to close around or release from a tubular drill string component.

Another object of the invention is to provide a variable bore ram rubber having a plurality of different shaped, non-overlapping metal inserts in different locations within the resilient matrix of the ram rubber, each shape being advantageously shaped to perform optimally at its particular location.

Another object of the invention is to provide a variable bore ram rubber which conforms exactly to the outer cylindrical wall surface of the largest diameter cylindrical component which the ram rubber is intended to accept, while conforming to smaller diameter components with a minimal amount of extrusion of resilient material.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiment. Accordingly, we do not intend that the scope of our exclusive rights and privileges in the invention be limited to details of the embodiments described. We do intend that equivalents, adaptations and modifications of the invention reasonably inferable from the description contained herein be included within the scope of the invention as defined by the appended claims.

SUMMARY OF THE INVENTION

Briefly stated, the present invention comprehends an improved sealing element or ram rubber for variable bore ram blowout preventers used in the drilling and operation of oil and gas wells and the like. The improved variable bore ram rubber according to the present invention has fewer component parts and a simpler construction than existing prior art ram rubbers.

In its basic embodiment, the novel variable bore ram rubber according to the present invention consists of two separate, identical sealing elements, each of which has an exterior shape which adapts the element to fit into either of two existing, opposed semi-circular ram blocks. Thus, each of the two identical halves of the variable bore ram rubber according to the present invention includes a face seal which is of generally uniform thickness, and has a symmetrical arch-shaped, semi-circular center section. Colinear, laterally disposed legs extend laterally outwards from the opposite bases of the arch.

One sealing element as described above is fitted into each of two laterally opposed, semi-circular ram blocks. When the ram blocks are forced towards one another into a sealing position, the flat outer faces of the legs of opposing sealing elements abut each other to form a pressure-tight seal. At the same time, the concave, semi-circular surfaces of opposed arches seal against opposite cylindrical sides of a tubular drill string component disposed through the bore of the ram sealing assembly, the bore being defined by the union of the two semi-circular arches.

The variable bore ram rubber according to the present invention employs metal inserts molded into a matrix of resilient material, such as rubber. In contrast to prior art variable bore ram rubbers which have a large number of metal segments or inserts of similar size and shape, the novel variable bore ram rubber according to the present invention uses a small number of inserts of different shape, each shape being particularly adapted to the location of the insert in the ram rubber.

The use of a small number of inserts is in accordance with applicants' discovery that, contrary to the teachings of the prior art, a small number of larger, specially shaped inserts yield better sealing action and longer life than a large number of smaller, similarly shaped segments. As is disclosed below, the present invention also utilizes applicants' further discovery that an improved variable bore ram rubber may be constructed which employs a sparse number of specially shaped, non-overlapping segments.

Thus, each of the two sealing elements comprising the variable bore ram rubber according to the present invention has two identical end inserts, one each at the outer lateral end of each lateral leg of the ram rubber, a center insert positioned inwards of the central arch of the ram rubber, and two identical corner inserts, one each located at the junction between a lateral leg and the central arch. Each of the five inserts listed above is positioned symmetrically about the longitudinal mid-plane of the ram rubber, and is symmetrically shaped about that mid-plane. Also, each of the inserts has identically shaped, parallel plate-like upper and lower sections joined together by a columnar pedestal section disposed perpendicularly between the plates.

In plan-view, each of the two end inserts has a generally square shape. The lateral sides of each of the two end inserts are perpendicular to the front, sealing face of the leg, adjacent a corner insert. The upper and lower plate of each corner insert has an outer lateral part which has in plan-view a generally square shape of approximately the same size as the adjacent end insert and also has a generally trapezoidal shaped inner part. The outer lateral edge of each corner insert is parallel to, and spaced slightly apart from the inner lateral edge of an adjacent end insert. However the outer longitudinal front or facial edge of each of the identical upper and lower plates of the corner inserts is laterally elongated. The innermost lateral plate edge joining the outer edge is concavely arcuate. The upper end of the concavely arcuate edge of the upper and lower plates of each corner insert is joined by a straight, obliquely disposed edge, the other end of which joins the inner or rear longitudinal edge of the corner insert plates, thus forming a generally trapezoidal shaped inner plate part.

The variable bore ram rubber according to the present invention includes a single center insert, which, in plan-view, has the shape of an annular sector having concentric rear and front arcuate edge walls, the latter defining the concave semi-circular face adjacent the bore of the ram rubber. The center insert has left and right edge walls substantially parallel to and spaced slightly apart from oblique inner edge walls of left and right corner inserts, respectively.

The novel shapes and relative positioning of the inserts described above cooperate to result in a variable bore ram rubber of improved durability and reliability, as well as simplified construction, as will be explained in detail below.

DESCRIPTION OF THE PREFERRED EMBODIMENTS

Figure 1:
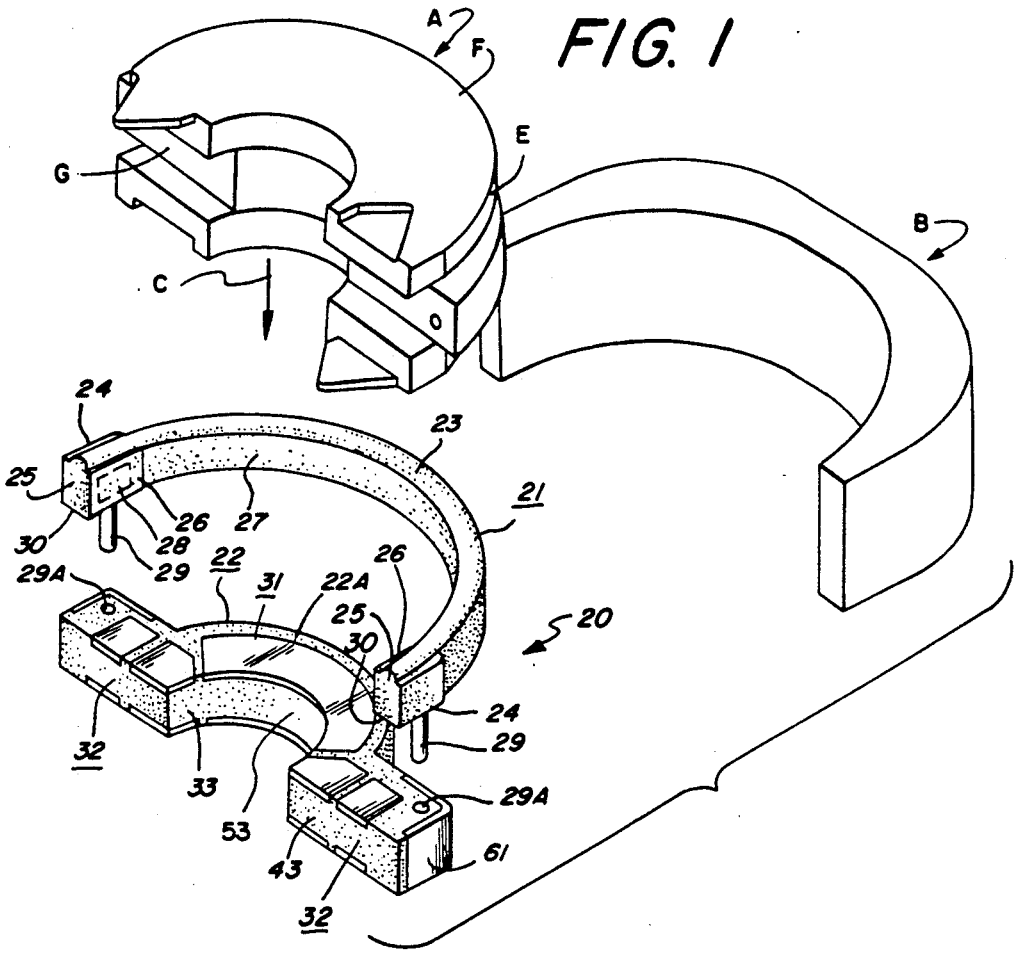
FIG. 1 is an exploded perspective view of one embodiment of the novel variable bore ram rubber according to the present invention, showing a typical blowout preventer ram block in which the ram rubber is intended to be installed.

Referring now to FIG. 1, an improved variable bore ram rubber according to the present invention is shown in relationship to a typical blowout preventer ram block in which the ram rubber is intended to be installed.

The variable bore ram rubber 20 according to the present invention is adapted to fit around a generally semi-circular cross-section ram block A. In the ram block A shown in FIG. 1, ram rubber 20 is secured to the ram block by a rear C-shaped holder B. However, ram rubber 20 may also be used with ram blocks which do not use a holder. In ram blowout preventers, two ram blocks A are positioned with the semi-circular bores C in the front diametrical faces D of the ram blocks facing each other. With the two ram blocks A positioned closely together, the semi-circular bores C in each of the ram blocks cooperate to form a longitudinally disposed bore adapted to receive tubular drill string components. Thus, a separate variable bore ram rubber 20 is required for each half of a ram blowout preventer. In operation of a ram blowout preventer, hydraulic rams drive opposed ram blocks radially inwards towards one another to enclose and form a tight circumferential seal against the outer cylindrical wall surface of a tubular well component located within the bore of the blowout preventer.

The embodiment 20 of the variable bore ram rubber shown in FIG. 1 consists of two components: a top seal 21 and a face seal 22. The function of top seal 21 is to fit around the rear circumferential surface E of upper semi-circular plate F of ram block A, and form a pressure-tight seal with the upper longitudinal surface of a ram cavity (not shown) in which each ram block is positioned. Sealing against the circumferential wall surface of drill string components is effected by face seal 22, seated against the front face of recessed center section G of ram block A.

As may be seen best by referring to FIG. 1, top seal 21 has the overall appearance of an elongated rectangular cross-section bar 23 that has been bent to form a semi-circular arch. Top seal 21 is fabricated from a resilient material, preferably an elastomer such as a good quality nitrile rubber. The outer lateral ends 24 of bar 23 have front faces 25 which are in co-planar alignment along a front chordal plane of top seal 21. Outer lateral ends 26 of front longitudinal face 27 of bar 23 are thus positioned parallel to one another, and perpendicular to front chordal plane of top seal 21. Flat, rectangular metal reinforcing inserts 28 are molded into top seal 21, just beneath the outer lateral ends 26 of bar 23.

Top seal 21 includes dowel-shaped metal fastening pins 29 which extend perpendicularly downwards from the lower surfaces 30 of the outer lateral ends 24 of bar 23. Fastening pins 20 are adapted to be insertably received by bores 29A provided in the upper face 22A of face seal 22. Preferably, dowel pins 29 protrude through bores 29A to be insertably received by bores in ram block A.

Figure 2:
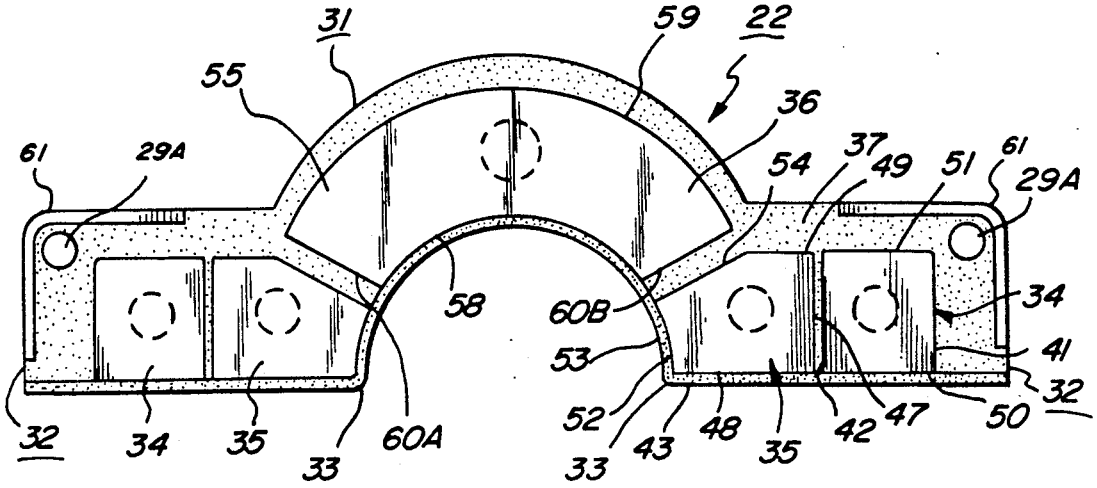
FIG. 2 is a fragmentary upper plan-view of the ram rubber of FIG. 1, showing the face seal portion thereof.
Figure 3:
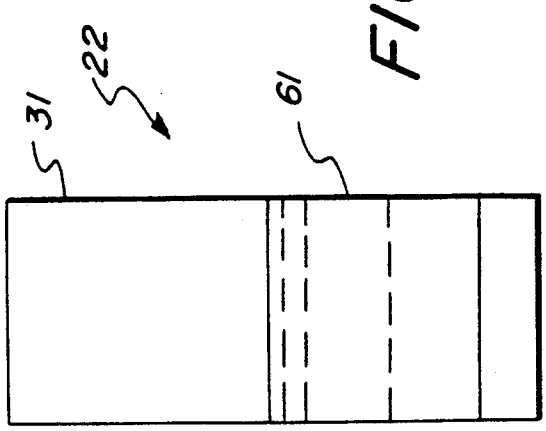
FIG. 3 is an end elevation view of the article of FIG. 2.

Referring now to FIGS. 1 through 3, the variable bore ram rubber 20 is seen to include a face seal 22 which is insertably fastenable to the top seal 21 described above. Face seal 22 has the appearance of an elongated, approximately square cross-section bar, a central longitudinal portion which has been bent rearwards to form a concave, generally semi-circular arch-shaped center section 31. The straight, "unbent" end portions of the bar form co-linear, laterally disposed legs 32 which extend laterally outwards from opposite base ends 33 of arch section 31.

Figure 4:
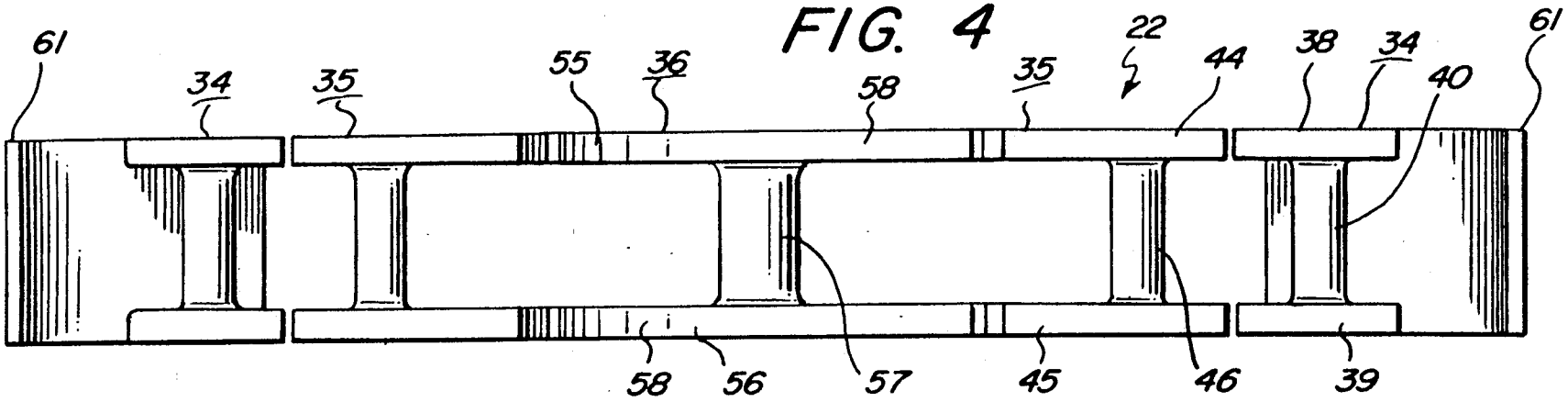
FIG. 4 is a skeletal front elevation view of the article of FIG. 3.

As may be seen best by referring to FIGS. 2 through 4, face seal 22 includes a plurality of metal inserts 34, 35 and 36 of novel design, molded into a resilient matrix 37. Matrix 37 is preferably made of a relatively hard elastomer, such as a nitrile rubber.

As shown in FIGS. 2 to 4, face seal 22 of ram rubber 20 has two end inserts 34, two corner inserts 35 and one center insert 36, for a total of five inserts. Each of the inserts 34, 35 and 36 have flat and parallel plate-like upper and lower members joined by a column-like pedestal disposed perpendicularly between the upper and lower members. Thus, each of the two end inserts 34 has an upper flat plate-like section 38, a lower flat plate-like section 39 of identical shape and orientation as that of upper section 38, and a circular cross-section pedestal 40 disposed perpendicularly between the inner faces of the upper and lower plates. Identically shaped upper and lower plates 38 and 39 of end inserts 34 have a generally square plan-view shape. Pedestal 40 joining upper and lower plates 38 and 39 is positioned concentrically with respect to the upper and lower plates. End inserts 34, as well as corner inserts 35 and center insert 36, are formed of a strong material such as steel, by forging or casting Preferably, end inserts 34 are made of low carbon or low alloy steel. The two corner inserts and center insert are preferably made of the same material, unless the ram rubber is intended to provide a hang-off capability, in which case the center and corner inserts would desirably be made of a harder steel. Each end insert 34 has parallel outer and inner lateral sides 41 and 42, respectively, disposed perpendicularly to the front or anterior face 43 of resilient matrix 37.

As shown in FIGS. 2 to 4, face seal 22 of variable bore ram rubber 20 also includes two corner inserts 35. Each corner insert has an upper flat plate-like section 44, a lower flat plate-like section 45 of identical shape and orientation as that of upper section 44, and disposed parallel thereto, and a circular cross-section pedestal 46 disposed perpendicularly between the inner faces of the upper and lower plates.

As may be seen best by referring to FIG. 2, each of the upper and lower plates 44 and 45 of each of the two corner inserts 35 has a straight outer side 47 disposed perpendicularly to the front or anterior sealing face 43 of matrix 37. Outer side 47 of each corner insert 35 is spaced slightly apart from the inner lateral side 42 of an adjacent end insert 34.

Each corner insert 35 has straight and parallel front and rear longitudinal sides 48 and 49 perpendicular to outer lateral side 47. Front and rear longitudinal sides 48 and 49 of corner insert 35 are co-planar with front and rear longitudinal sides 50 and 51, respectively, of end inserts 34.

Front longitudinal side 48 of corner insert 35 is substantially longer than rear longitudinal side 49, extending laterally inwards from outer side 47 to join a concavely curved inner side 52. Concavely curved inner side 52 of corner insert 35 is concentric with and displaced radially inwards from the concave wall surface 53 of matrix 37 which lies in arch section 31, and which surface is coextensive with front or anterior face 43 of the matrix.

Each corner insert 35 has a straight, obliquely disposed side 54 which extends generally radially rearward and outwards from curved side 52 to join rear longitudinal side 49 at an oblique angle.

Referring again primarily to FIG. 2, face seal 22 of variable bore ram rubber 20 is seen to also include a single center insert 36. Center insert 36 has an upper flat plate-like section 55, a lower flat plate-like section 56 of identical shape and orientation as that of upper section 55 and disposed parallel thereto, and a circular cross-section pedestal 57 disposed perpendicularly between the inner faces of the upper and lower plates.

Upper and lower plates 55 and 56 of center insert 36 have the shape of an annular sector having a front semi-circular edge wall 58, a rear semi-circular edge wall 59, concentric with the front edge wall, and left and right radial edge walls 60A and 60B, respectively. Front semi-circular edge wall 58 of center insert 36 is concentric with and displaced radially inwards from concave wall surface 53 of matrix 37. Radially disposed edge walls 60A and 60B of center insert 36 are parallel to and spaced slightly apart from adjacent obliquely disposed sides 54 of corner inserts 35.

As shown in FIGS. 1-4, face seal 22 also has two reinforcing inserts 61, one each at the rear outer corner of each leg 32 of the face seal. Each reinforcing insert has the shape of an L-bracket, the height of which is approximately equal to the longitudinal thickness of the face seal. The outer surfaces of the two legs of insert 31 are coextensive with the rear and outer lateral surfaces respectively, of legs 32. The inner dihedral intersection line of each leg of insert 31 is positioned close to an adjacent bore 29A. Also, each insert 61 is located symmetrically with respect to a bore 29A, such that the outer end of each leg of the bracket is equidistant from the bore.

Figure 5:
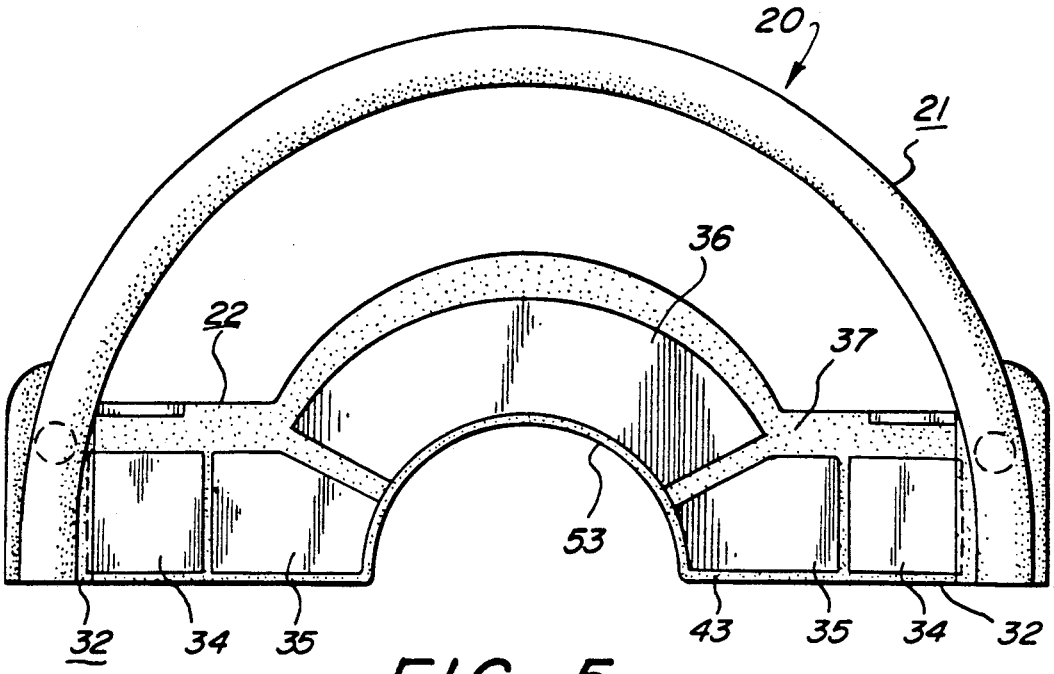
FIG. 5 is an upper plan-view of the article of FIG. 1, showing the ram rubber in a relaxed, uncompressed position, with no tubular member present in its bore.
Figure 6:
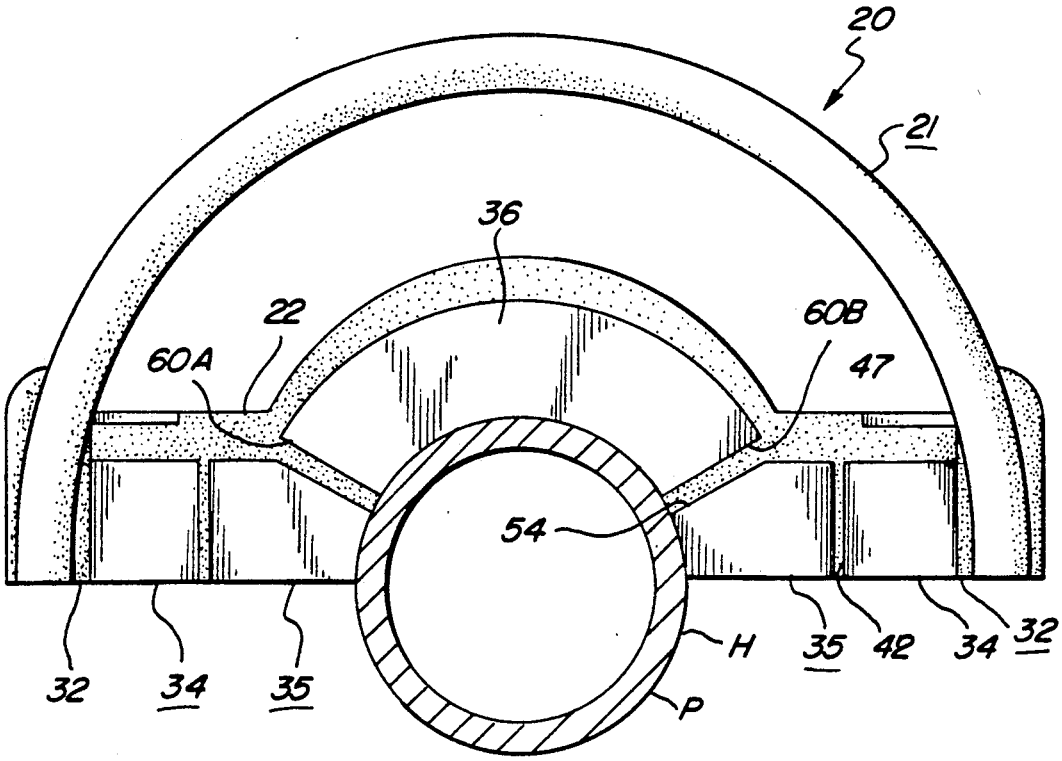
FIG. 6 is an upper plan-view similar to that of FIG. 5, but showing the ram rubber compressed against a $2\frac{7}{8}$ inch diameter pipe.
Figure 7:
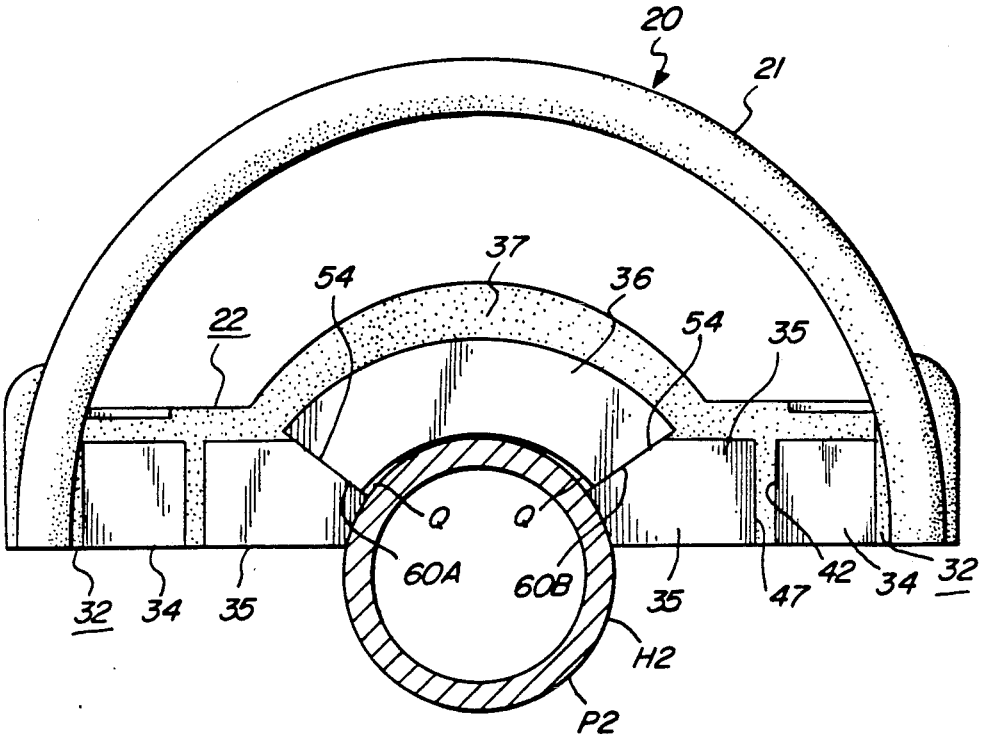
FIG. 7 is an upper plan-view similar to that of FIG. 6, but showing the ram rubber compressed against a $2\frac{3}{8}$ inch diameter pipe.

FIGS. 5 through 7 illustrate operation of the variable bore ram rubber according to the present invention.

As shown in FIG. 5, variable bore ram rubber 20 is in a relaxed position, installed in a ram block of the type shown in FIG. 1. In this position, the rubber matrix 37 in which inserts 34, 35 and 36 are imbedded extends forward or outward of the front surfaces of the upper and lower plates of the inserts. Thus, as shown in FIG. 5, the flat front or anterior face 43 of resilient matrix 37 extends forward of the front edges of the upper and lower plate sections of end inserts 34 and corner inserts 35. Also, the concave anterior wall surface 53 of resilient matrix 37 extends forward or outward from the curved front edges of the upper and lower plate sections of center insert 36.

FIG. 6 illustrates the configuration of variable bore ram rubber 20 when it and an identical ram rubber, not shown, located in a mirror image position, are forced radially inwards towards one another by opposed hydraulic rams, to contact one another and also to contact the outer circumferential wall surface H of pipe P. In this position, the concave contour of center arch section 36 of ram rubber 20 exactly conforms to the contour of outer wall surface H of the largest diameter pipe P which the ram rubber is intended to be used with. Thus, for example, FIG. 6 may depict the sealing of ram rubber 20 against the outer wall surface H of a pipe P having an outer diameter of $2\frac{7}{8}$ inches. As shown in FIG. 6, the lateral spacing between facing edge walls 42 and 47 of each end insert 34 and adjacent corner insert 35 is reduced minimally, if at all, from the corresponding spacing shown for the relaxed ram rubber 20 in FIG. 5. Also, the spacing between radial edge walls 60A and 60B of center insert 36 and oblique edge walls 54 of corner insert 35 is also reduced minimally, if at all, from the spacing shown for the relaxed ram rubber 20 in FIG. 5.

FIG. 7 shows the configuration of variable bore ram rubber 20 when forming a seal with the outer circumferential wall surface H2 of a pipe P2 of smaller diameter than pipe P shown in FIG. 6. Inward normal forces are exerted on front or outer faces 43 and 53 of face seal 22 as a result of hydraulic rams forcing a pair of opposed variable bore ram rubbers 20 into abutting contact with one another. These normal forces cause the resilient, rubbery material of which matrix 37 is composed to cold-flow. Cold-flow of the rubber in turn causes each corner insert 35 to reversibly move laterally inwards from an adjacent end insert 34, thus increasing the gap between adjacent lateral edges 47 and 42 of the two inserts, as shown in FIG. 7.

Corner inserts 35 will continue to move inward until the oblique edge walls 54 of the corner inserts contact radial edges 60 of center insert 36, when ram rubber 20 is used to seal against the smallest diameter pipe or other tubular drill string component which it is intended to be used with.

In contrast to prior art variable bore ram rubbers which utilize a large number of small inserts, variable bore ram rubber 20 according to the present invention extrudes rubber into only two small crescent-shaped regions Q, as shown in FIG. 7, rather than into many regions. Thus, the amount of rubber pinched off and removed from the seal during each actuation of the variable bore ram rubber 20 is reduced, increasing its useful life over that of prior art devices.

Figure 8:
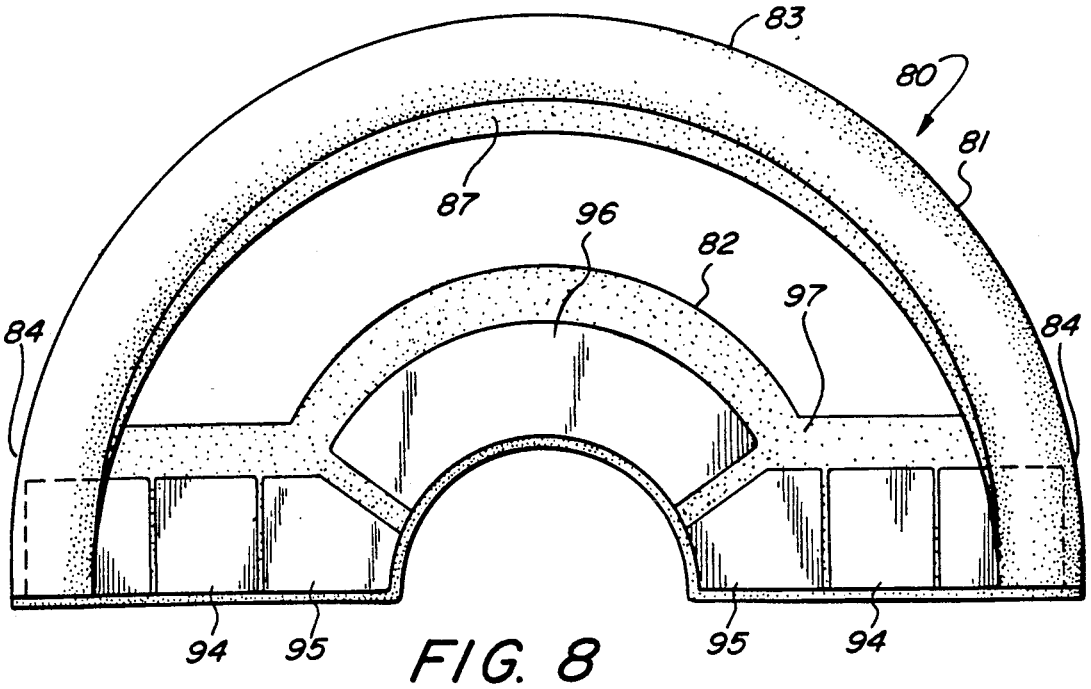
FIG. 8 is an upper plan-view of another embodiment of a variable bore ram rubber according to the present invention.
Figure 9:
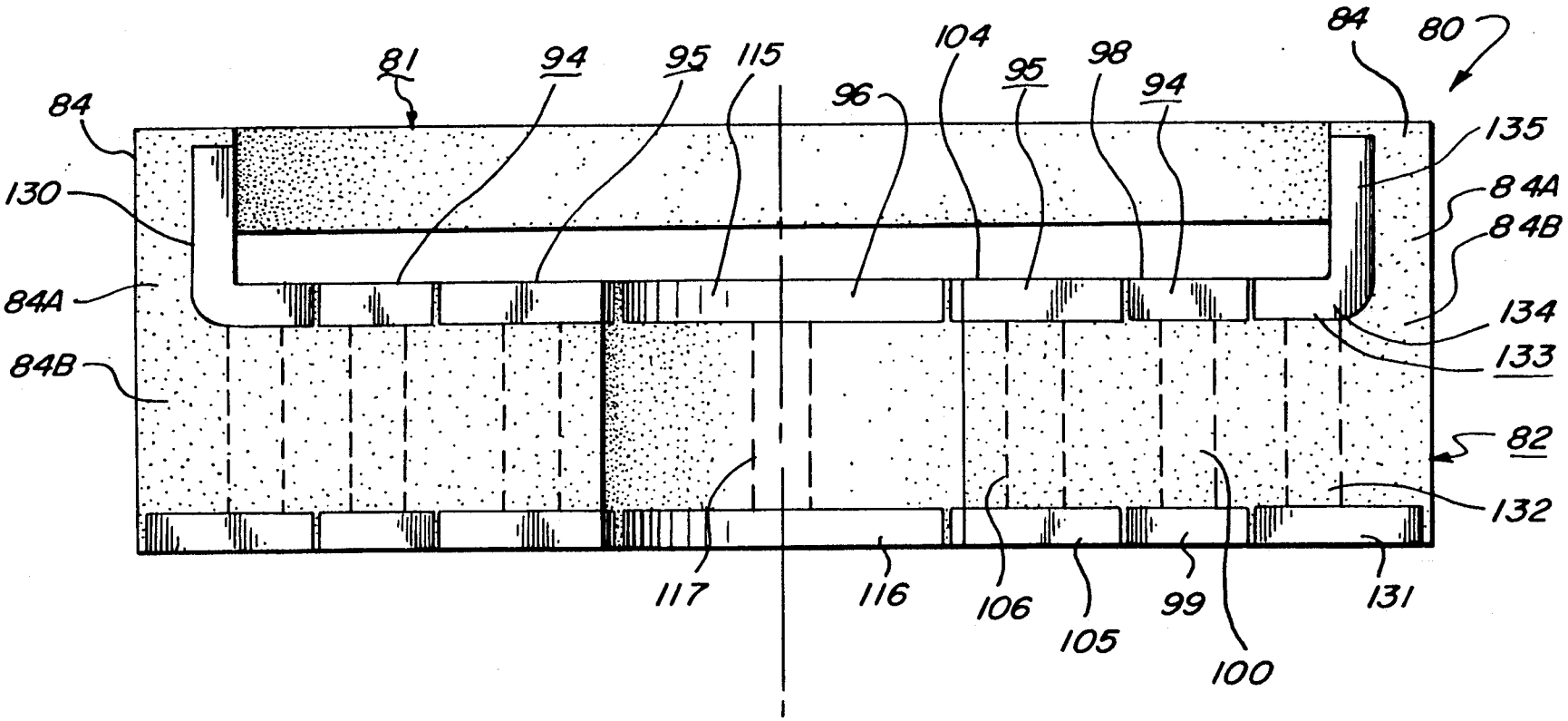
FIG. 9 is a front elevation view of the article of FIG. 8.

FIGS. 8 and 9 illustrate another embodiment 80 of a variable bore ram rubber according to the present invention. Ram rubber 80 is similar in structure and function to ram rubber 20 discussed above. However, ram rubber 80 has an integral top seal section 81 and face seal section 82. Top seal section 81 has the overall appearance of an elongated rectangular cross-section bar 83 bent to form a semi-circular arch. Outer lateral ends 84 of bar 83 have downwardly depending legs 84A which join the upper surfaces of the outer lateral ends 84B of face seal section 82.

Face seal 82 has two end inserts 94, two corner inserts 95, and one center insert 96 substantially similar in structure and function to the corresponding inserts 34, 35 and 36 of embodiment 20 of the variable bore ram rubber described above. Additionally, face seal 82 has two outer flanged inserts 130, one each located laterally outwards of each of the two end inserts 94. Each outer flanged insert 130 has a generally square cross-section flat base plate 131, a circular cross-section pedestal 132 extending perpendicularly upwards from the upper surface of the base plate. Outer flanged insert also has an upper plate section 133. As shown in FIG. 9, upper plate section 133 of outer flanged insert 130 has an L-shape in elevation view, comprising a flat plate section 134 parallel to base plate 131, and an upstanding flange section 135. Upstanding flange sections 135 function as a connecting member between the outer lateral ends of face seal section 82 and top seal section 81.

What is claimed is:

1. An improved sealing element for use in a sealing apparatus of the type used for forming a fluid pressure-tight seal with at least part of the outer convex surface of a tubular member, said sealing apparatus comprising two identical, laterally opposed sealing elements having in plan view a generally semi-circular shape adapted to fit around a semi-cylindrical ram block and adapted to abut one another along a front diametrical plane, said improved sealing element comprising;

a. an arch-shaped resilient top seal section adapted to encircle the rear semi-cylindrical surface of a ram block, said top seal having the overall shape of a generally rectangular cross-section bar bent into an arch having at opposite lateral ends thereof of downward depending fastening means, b. a face seal fastenable to said top seal, said face seal being adapted to fit into the front diametrical face of a ram block, said face seal being a composite structure made of a plurality of metal inserts of different shapes imbedded in a resilient matrix and having the overall external appearance of a straight, generally rectangular cross-section bar bent to form a symmetrical arch-shaped center section having coplanar, laterally disposed legs which protrude perpendicularly outwards from opposite bases of said arch, each of said inserts being positioned symmetrically about the longitudinal mid-plane of said face seal and being symmetrically shaped about said mid-plane, each of said inserts comprising an upper plate section joined to a parallel, longitudinally aligned, lower plate section by a pedestal member disposed perpendicularly between the adjacent faces of said upper and lower plate sections, the longitudinal axis of said pedestal being symmetrically positioned with respect to the perimeter of said plates, said plurality of inserts comprising, i. an end insert at the outer lateral end of each of the two said legs, the plate sections of said end insert having a generally square shape, the front edges of which are parallel to and slightly rearward of the front longitudinal faces of said legs, a rear edge parallel to said front edge, and outer and inner lateral edges perpendicular thereto, ii. a corner insert located laterally inwards of each of two said end inserts, the plate sections of each of said corner inserts having an elongated straight front edge longitudinally aligned with said front edges of said end inserts, an outer lateral edge which is perpendicular to said front edge of said corner insert, and parallel to and spaced laterally inwards from said inner lateral end of an adjacent one of said end inserts, a relatively short, straight rear edge coplanar with said rear edge of said end inserts, a straight oblique edge intersecting said rear edge at an obtuse angle and disposed laterally inwards and forward from said rear edge, and a relatively short arcuate, concavely curved inner lateral edge joining said oblique edge to said front edge, said inner lateral edge being concentric with and lying radially outwards or rearwards of the concave wall surface of said central arch section, and iii. a single center insert, the plate sections of said center insert having the shape of a sector of a circle having a front concave edge concentric with and lying radially outwards or rearwards of said concave wall surface of said central arch section, and a rear convex edge concentric with said front concave edge and lying radially inwards or forward of the rear convex wall surface of said central arch section, and two straight radial edges, one each lying parallel to and spaced laterally inwards of an oblique edge of an adjacent one of said corner inserts.

2. The sealing element of claim 1 wherein the radius of said concave wall of said central arch section is made equal to the radius of the largest diameter tubular component which said sealing element is intended to be used with.

3. The sealing element of claim 2 wherein said spacing between each of said radial edges of said center insert and the oblique edge of an adjacent one of said corner inserts is such as to cause said radial edge to contact an oblique edge when said concave edges of said corner inserts and said center insert contact the cylindrical wall surface of the smallest size tubular component which is intended to be sealed by said sealing element.

* * * * *